US008505579B2

(12) United States Patent
Esche et al.

(10) Patent No.: US 8,505,579 B2
(45) Date of Patent: Aug. 13, 2013

(54) SELECTABLE FLUID VALVE ASSEMBLY

(75) Inventors: John C. Esche, Kohler, WI (US); Leila M. Rubin, Sheboygan, WI (US); David Eugene Hansen, Howards Grove, WI (US)

(73) Assignee: Kohler Co., Kohler, WI (US)

( * ) Notice: Subject to any disclaimer, the term of this patent is extended or adjusted under 35 U.S.C. 154(b) by 206 days.

(21) Appl. No.: 12/962,024

(22) Filed: Dec. 7, 2010

(65) Prior Publication Data

US 2011/0214769 A1 Sep. 8, 2011

Related U.S. Application Data

(60) Provisional application No. 61/267,701, filed on Dec. 8, 2009.

(51) Int. Cl.
*F16K 11/078* (2006.01)

(52) U.S. Cl.
USPC ..... 137/625.4; 251/288

(58) Field of Classification Search
USPC ..... 137/605, 625.4, 625.41, 625.48, 137/383; 251/284, 288
See application file for complete search history.

(56) References Cited

U.S. PATENT DOCUMENTS

| | | | | |
|---|---|---|---|---|
| 3,628,570 | A * | 12/1971 | Andis | 137/625.23 |
| 4,200,123 | A * | 4/1980 | Brandelli | 137/625.4 |
| 4,449,551 | A * | 5/1984 | Lorch | 137/625.41 |
| 5,507,314 | A * | 4/1996 | Knapp | 137/625.41 |
| 5,613,521 | A | 3/1997 | Knapp | |
| 5,983,938 | A * | 11/1999 | Bowers et al. | 137/625.17 |
| 6,729,344 | B1 * | 5/2004 | Hung | 137/339 |
| 7,137,410 | B2 * | 11/2006 | Rosko | 137/625.17 |
| 2008/0110502 | A1 | 5/2008 | Oh | |

FOREIGN PATENT DOCUMENTS

DE 203 19 169 2/2004

OTHER PUBLICATIONS

International Search Report and Written Opinion for PCT/US2010/059225, mail date May 19, 2011, 12 pages.

* cited by examiner

*Primary Examiner* — John Rivell
*Assistant Examiner* — Reinaldo Sanchez-Medina
(74) *Attorney, Agent, or Firm* — Foley & Lardner LLP

(57) ABSTRACT

Valve assemblies are provided that have a selection member engaged with a housing to provide control of fluid communication between first and second fluid pathways. Positioning the selection member within a selection cavity of the housing provides fluid communication with a corresponding fluid pathway. An optional locking member can engage the valve assembly to prevent fluid communication with at least one fluid pathway.

23 Claims, 8 Drawing Sheets

SELECTABLE FLUID VALVE ASSEMBLY

BACKGROUND

This present disclosure generally pertains to valve assemblies that comprise a housing and a selection member for selectively allowing fluid communication between a fluid inlet and a fluid outlet. More particularly, the present disclosure relates to a valve assembly for a liquid dispenser. The valve assemblies, exhibiting maximum efficiency of the liquid dispenser, allow fluid communication between a single fluid pathway and any one of multiple fluid pathways.

SUMMARY

An aspect or embodiment of the disclosure pertains to an improved valve assembly that comprises a housing and a selection member. The disclosure includes a housing with a single fluid inlet and corresponding multiple fluid outlets, or a single fluid outlet and corresponding multiple fluid inlets. For example, the housing can have a single water inlet and multiple water outlets for cold, hot and room temperature water. Conversely, the housing can have multiple fluid inlets corresponding to different flavors of liquid and a single fluid outlet for dispensing the flavored liquid, for example.

In accordance with another aspect or embodiment, the selection member is a joystick having a portion seated within the housing. The joystick is movable between the multiple fluid pathways. The joystick operation allows for easy manipulation of the selection member, thus simplifying operation and minimizing wear and user strain for example.

In still another aspect or embodiment, the multiple fluid pathways are arranged in the housing in a specific pattern. The type of pattern used allows for design flexibility in working with the number of multiple fluid pathways and the end use of the valve assembly. For example, the housing can have one inlet and three outlets arranged in a T pattern or a Y pattern. Each end point of the T or Y pattern can enable a outlet to be in fluid communication with the inlet, and the center point of the T or Y pattern can prevent any fluid communication with the inlet, for example.

In yet another aspect or embodiment, any one of the inlet or outlet pathways can be throttled. Throttling allows for a range of fluid communication through the specific pathway. For example, a specific outlet pathway can be throttled to allow for specific settings of ¼, ½, ¾ and full fluid flow. Each fluid pathway can have the same throttling characteristics, or each fluid pathway can have different throttling characteristics, for example.

In another aspect or embodiment, the valve assembly can also include a locking member. The locking member prevents fluid communication with specific fluid pathways. For example, a water faucet can have a valve assembly having a cold water outlet, a hot water outlet and a locking ring, where engaging the locking ring prevents the hot water outlet from working.

It is the intention of at least one embodiment of the disclosure to provide a valve assembly including: a housing having a seating cavity, at least one selection cavity, and at least one first and second fluid pathway, a selection member having a seating portion and an engagement portion, and wherein at least a portion of the seating portion is contained within a portion of the seating cavity.

In an aspect of the disclosure, multiple selection cavities form a first pattern. In another aspect of the disclosure, the first pattern is one of a Y pattern, a T pattern or a linear pattern. In yet another aspect of the disclosure, the first and second fluid pathways form a second pattern. In another aspect of the disclosure, the second pattern is one of a Y pattern, a T pattern or a linear pattern.

In a further aspect of the disclosure, the selection member is operated as a joystick. In another aspect of the disclosure, the joystick is movable within the pattern of selection cavities. In a further aspect of the disclosure, the joystick must be moved through a first position when the joystick is moved between the selection cavities.

Yet another aspect of the disclosure further includes that the seating portion is sized and shaped to block fluid communication between a first fluid pathway and a second fluid pathway when the seating portion is in a first position. Another aspect of the disclosure includes that the seating portion is sized and shaped to block fluid communication between a first fluid pathway and a second fluid pathway when the seating portion is in a second position. In another aspect of the disclosure, the seating portion is sized and shaped such that the rate of fluid communication between a first fluid pathway and a second fluid pathway changes as the seating portion is moved from a first position to a second position. In a further aspect of the disclosure, the valve assembly is receivably engaged by a locking member. In a further aspect of the disclosure, the locking member is a rotatable ring.

In another aspect of the disclosure, the seating portion and the seating cavity form a ball and socket arrangement. In yet another aspect of the disclosure, fluid communication between the first and second fluid pathways is volume controlled by one of a gate in at least one of the first and second fluid pathways, a filter in at least one of the first and second fluid pathways, and the size and shape of the seating portion. In a further aspect of the disclosure, the valve assembly further includes a detent.

It is the intention of at least one embodiment of the disclosure to provide a valve assembly including: a housing having a seating cavity, at least one selection cavity, at least one fluid inlet and at least on fluid outlet, a selection member having a seating portion and an engagement portion, and wherein at least a portion of the seating portion is contained within a portion of the seating cavity.

In another aspect of the disclosure, the housing has one fluid inlet and one of two fluid outlets and three fluid outlets. In yet another aspect of the disclosure, the housing has one fluid outlet and one of two fluid inlets and three fluid inlets.

It is the intention of at least one embodiment of the disclosure to provide a fluid dispenser assembly including: a dispenser housing having at least one fluid inlet and at least one fluid outlet, an actuating member, and a valve assembly, the valve assembly including a housing having a seating cavity, at least one selection cavity, and at least one first and second fluid pathway, a selection member having a seating portion and an engagement portion, and wherein at least a portion of the seating portion is contained within a portion of the seating cavity.

DETAILED DESCRIPTION

As required, detailed embodiments of the present disclosure are disclosed herein; however, it is to be understood that the disclosed embodiments are merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure in virtually any appropriate manner.

Figure 1:
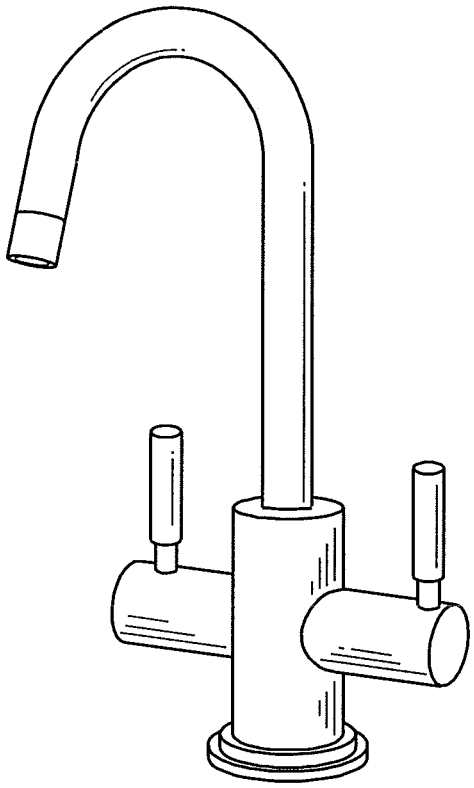
FIG. 1 is a perspective view of a faucet having multiple valves.
Figure 2:
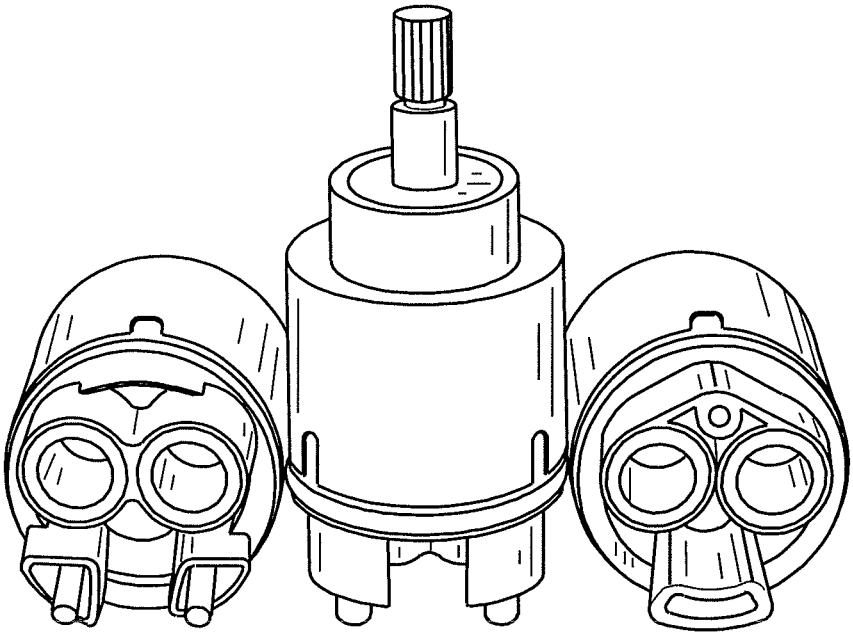
FIG. 2 PRIOR ART
FIG. 2 is a perspective view of a rotary diverter/mixing cartridge.
Figure 3:
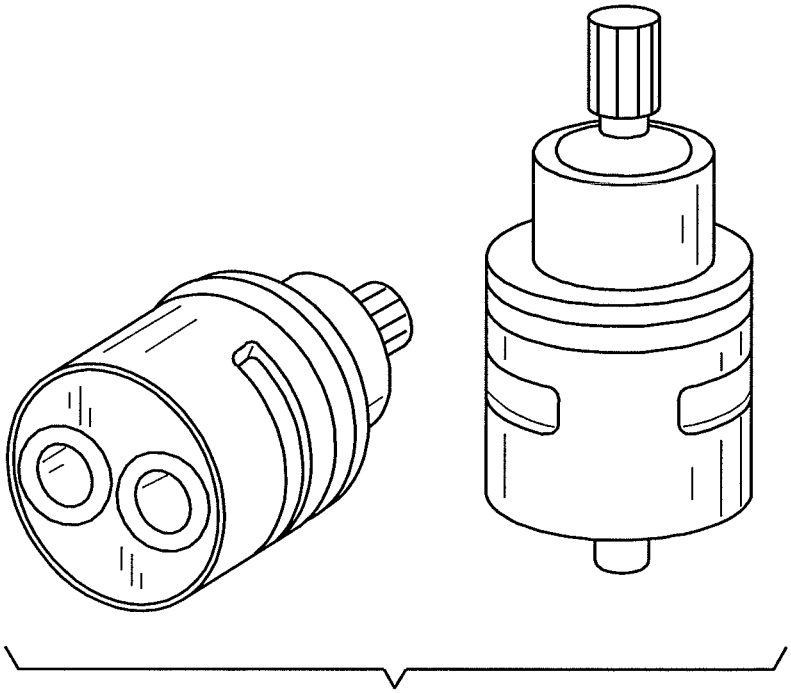
FIG. 3 PRIOR ART
FIG. 3 is a perspective view of a rotary diverter cartridge.

FIG. 1 illustrates a typical faucet having one handle for cold water and one handle for hot water. Each handle operates a separate valve that is in fluid communication with a separate fluid inlet. One valve is connected to a cold water source and one valve is connected to a hot water source, with both valves being connected to the faucet outlet. FIG. 2 illustrates a typical rotary diverter/mixing cartridge. The cartridge is rotated to select one of two outlet ports to be in fluid communication with the inlet port when the cartridge is used as a diverter. When the cartridge is used as a mixing cartridge, fluid enters both inlet ports and mixes together before being discharged through the outlet port. FIG. 3 illustrates another typical rotary diverter in which fluid enters an inlet opening on the side and exits one of two outlet ports on the bottom. Typically, if used as a diverting valve, an additional valve is required to provide on-off and volume control functions for each of the devices of FIGS. 2 and 3.

Figure 4:
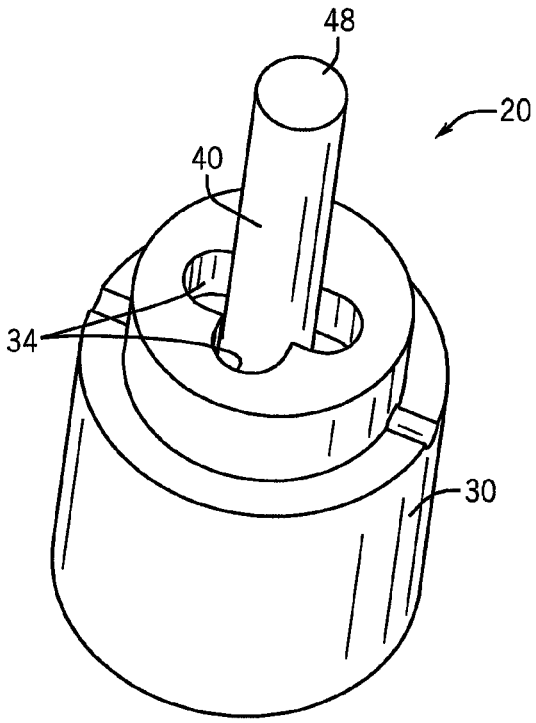
FIG. 4 is a perspective view of an embodiment of a valve assembly.
Figure 5:
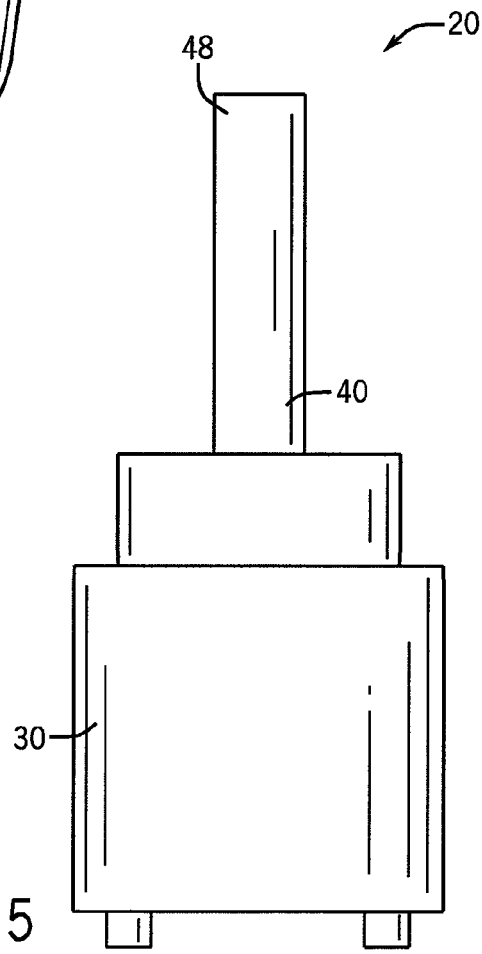
FIG. 5 is a side view of the valve assembly of FIG. 4.

FIG. 4 illustrates an exemplary embodiment of a valve assembly generally described as 20. Valve assembly 20 includes a housing 30 and a selection member 40. This concept allows a single fluid (e.g. water) source to enter a single small one handle (e.g. joystick type) control valve. Then the user can select from multiple outlets. The flow volume can be off, full on, or variable between off and full on. Flow is delivered only to one outlet and not mixed between the outlets.

Figure 10:
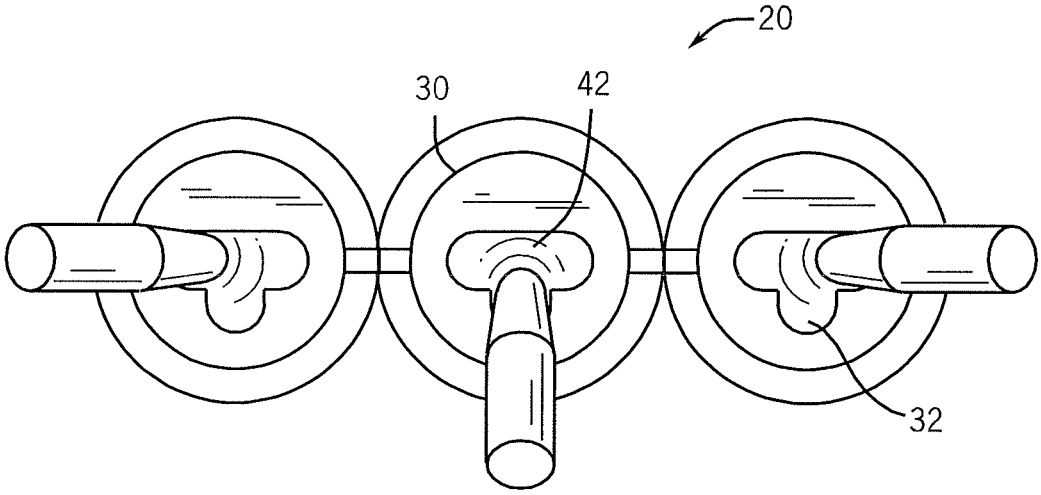
FIG. 10 is a perspective view of multiple valve assemblies.

Referring further to FIG. 10, selection member 40 includes a seating portion 42 that is engaged within a seating cavity 32 of housing 30 according to an exemplary embodiment. Seating portion 42 can be any desired shape that allows for movement within seating cavity 32, such as a rounded or spherical bearing creating a ball and socket arrangement, for example. Seating portion 42 is movable within seating cavity 32. For example, seating portion 42 can pivot within seating cavity 32. Selection member 40 also includes an engagement portion 48. Engagement portion 48 can be connected to an engagement device (not shown) such as a faucet handle, for example. Selection member 40 can be a single integrated unit or it can be an assembly of separate parts, for example. Selection member 40 is made of any industry standard material such as metal or plastic for example. Selection member 40 in the illustrated embodiment is made of metal.

Housing 30 includes at least one selection cavity 34 according to an exemplary embodiment. According to the exemplary embodiment shown in FIGS. 4-7, housing 30 includes three selection cavities 34. Each selection cavity 34 is sized and shaped to accept a portion of selection member 40 when selection member 40 is moved towards selection cavity 34 (e.g., from the off position to toward selection cavity 34).

Figure 6:
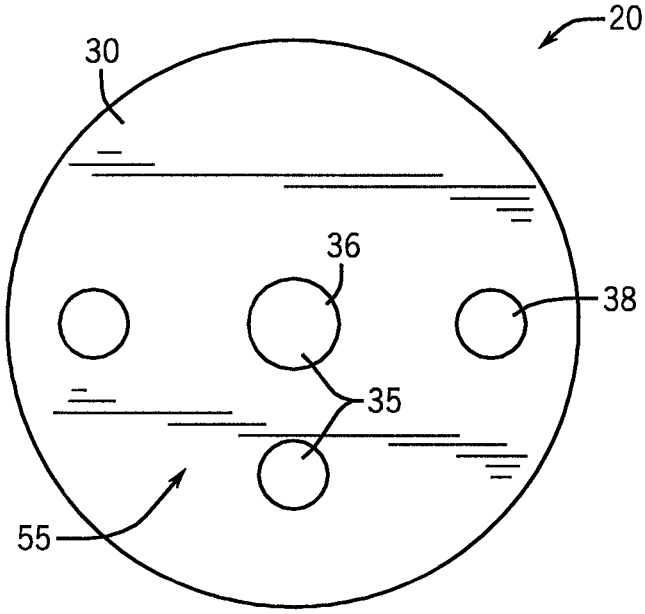
FIG. 6 is a bottom view of the valve assembly of FIG. 4.
Figure 9:
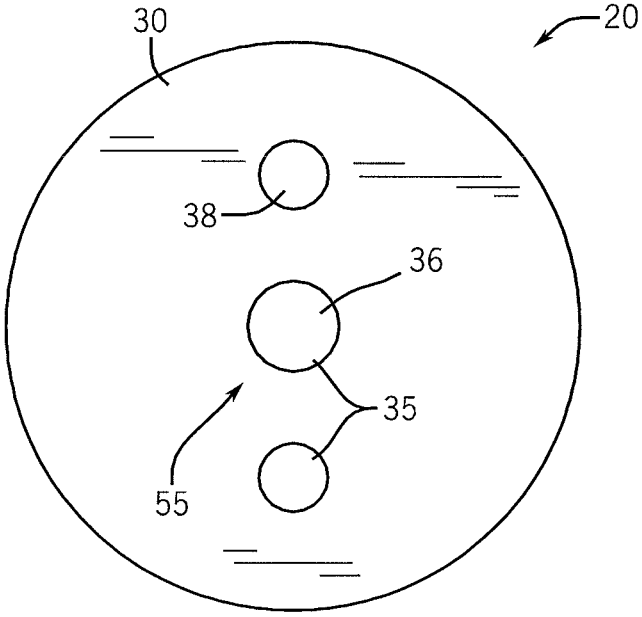
FIG. 9 is a bottom view of another embodiment of a valve assembly.

Housing 30 also includes multiple fluid pathways 35 having at least one first fluid pathway 36 and at least one second fluid pathway 38 according to an exemplary embodiment. The fluid pathways extend through the housing 30 and provide paths for fluid to travel from a fluid inlet to a fluid outlet. Housing 30 in the illustrated embodiment includes one first fluid pathway 36 and three second fluid pathways 38, as can be seen in FIG. 6. Fluid pathways 36,38 can be sized and shaped in any desired manner, such that each fluid pathway 36,38 can be sized and shaped the same as or differently from any other fluid pathway 36,38. As to the illustrated embodiment of FIG. 6, first fluid pathway 36 can be a fluid inlet and second fluid pathways 38 can be fluid outlets such that a fluid from the fluid inlet can be routed to a particular fluid outlet, for example. Each fluid outlet can provide/direct the incoming fluid to a desired process before it is eventually distributed, such as heating, chilling, or mixing with other fluids for example. In an exemplary embodiment, the fluid inlet is room temperature water and the fluid outlets include one fluid outlet connecting to a heater, one fluid outlet connecting to a chiller, and one fluid outlet allowing the room temperature water to pass through. According to other exemplary embodiments, housing 30 can include any number of first and second fluid pathways 36,38. Referring, for example to FIG. 9, the housing 30 is shown having one first fluid pathway 36 and two second fluid pathways 38. Further, it should be noted that the number of outlets can be effectively varied by blocking off (e.g., closing off, obstructing, etc.) one or more outlets in a multi-outlet system.

Alternatively, the fluid inlet and outlets can be switched such that there can be multiple fluid inlets and one fluid outlet. In this case, first fluid pathway 36 is a fluid outlet and second fluid pathways 38 are fluid inlets. For example, each fluid inlet 38 could provide a different flavored liquid, each of which is discharged through the fluid outlet 36, such as in a soda fountain dispenser, for example.

Figure 7:
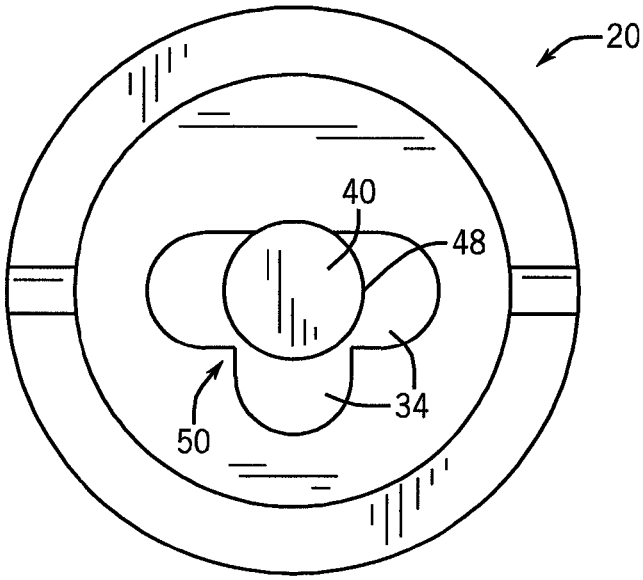
FIG. 7 is a top plan view of the valve assembly of FIG. 4.
Figure 8:
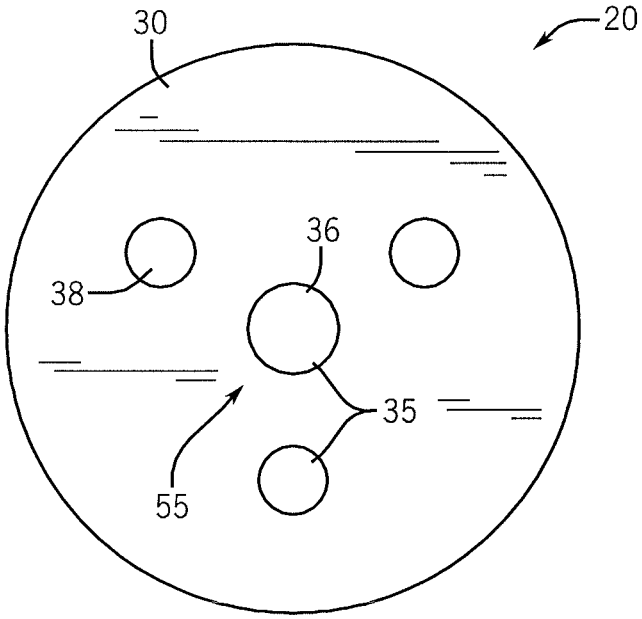
FIG. 8 is a bottom view of another embodiment of a valve assembly.

Selection cavities 34 can be arranged within housing 30 in any number of patterns, for example in a first pattern 50, as shown in FIG. 7. First pattern 50 defines the motions in which the user moves selection member 40 between different settings, such as off, full on or a variable between off and full on, for example. Fluid pathways 35 can be arranged within housing 30 in a second pattern 55, as shown in FIGS. 6, 8 and 9. Second pattern 55 can be configured as desired, such as to effectively mate with fluid system processes for example. First pattern 50 can correspond to or differ from second pattern 55 as desired. For example, in the exemplary embodiment shown in FIGS. 4-7 both the first pattern 50 and the second pattern 55 are T-shaped patterns. Positioning engagement portion 48 in a first position (e.g. the center) of the pattern causes the seating portion 42 to block fluid communication between first fluid pathway 36 and any of second fluid pathways 38. Such a position can be considered the "off" position for example. Positioning engagement portion 48 in a specific selection cavity 34 causes seating portion 42 to rotate within seating cavity 32, causing a corresponding second fluid pathway 38 to become in fluid communication with first fluid pathway 36 and thus allowing fluid to flow through.

Alternatively, second pattern 55 can be arranged in a pattern other than a T-shaped pattern. In another exemplary embodiment as shown in FIG. 8, the pattern is a Y-shaped pattern. In still another exemplary embodiment as shown in FIG. 9, the pattern is a linear pattern. Any other pattern may be formed from any number of fluid inlets 38 and fluid outlets 36 as desired.

Seating portion 42 can be sized and/or shaped to affect the fluid flow as the selection member 40 (e.g. joystick) is transitioned between a first pathway and a second pathway. For example, fluid communication between first and second fluid pathways 36,38 can be either fully blocked or fully open depending upon the position of the selection member 40. Alternatively, seating portion 42 can be sized and/or shaped so that fluid communication between first and second fluid pathways 36,38 is increased gradually or in stepped increments from fully blocked to fully open, providing for volume control or throttling, for example. For example, stepped increments of ¼, ½, ¾ and full fluid flow can be used as throttling settings. Volume control or throttling can be accomplished alternatively, such as by a gate or filter in at least one of first and second fluid pathways 36,38 for example. Each fluid pathway 36,38 can have any desired throttling characteristics such that each fluid pathway 36,38 has different throttling characteristics, all fluid pathways 36,38 have the same throttling characteristics, at least one fluid pathway 36,38 has no throttling, or any combination as desired.

Housing 30 can be made of any industry standard material such as metal or plastic, for example. Housing 30 in the illustrated embodiment of FIGS. 4-7 is made of plastic. Housing 30 can be sized and shaped as desired, such as a cubic, cylindrical or spherical shape, for example. Housing 30 in the illustrated embodiment of FIGS. 4-7 is shown having a cylindrical shape.

Figure 11:
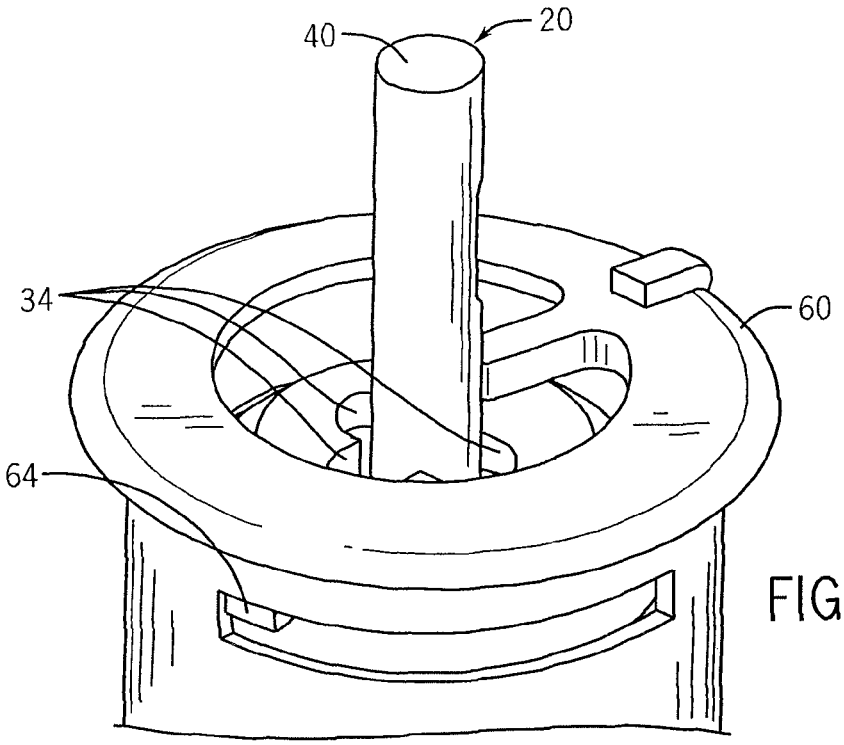
FIG. 11 is a perspective view of a portion of a faucet containing the valve assembly of FIG. 4 and a locking mechanism.
Figure 12:
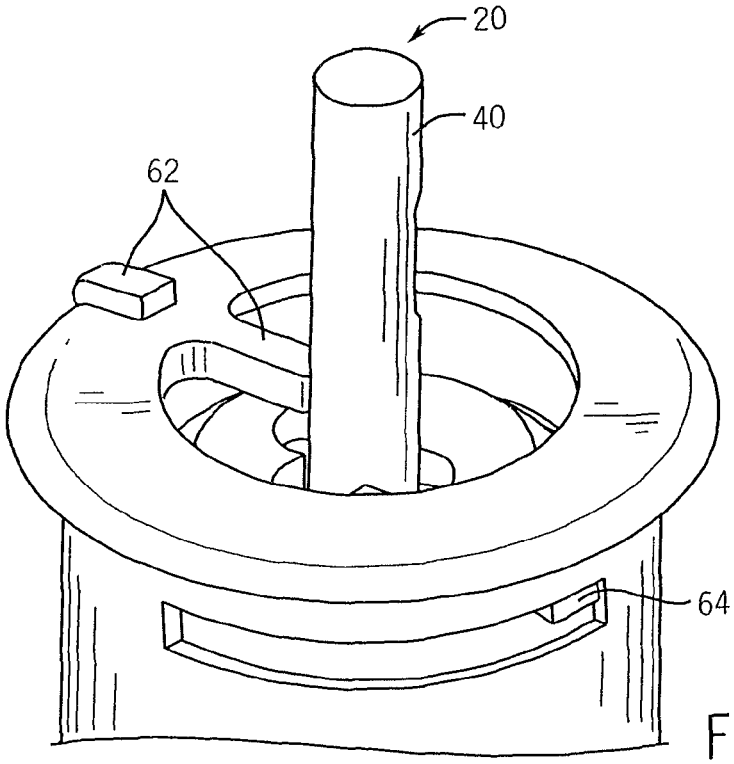
FIG. 12 is another perspective view of the faucet of FIG. 11.

Valve assembly 20 can also be sized and shaped to receive a locking member 60 that can operate to prevent fluid flow from a specific fluid inlet 38 or fluid outlet 36 as desired. As seen in FIGS. 11 and 12, locking member 60 can be a part of an assembly within which valve assembly 20 is contained, such as a faucet housing or beverage dispenser, for example. Locking member 60 may be any type of movement restricting arrangement such as tabs, detents, springs or rings for example. In the illustrated embodiment of FIGS. 11 and 12, locking member 60 is a rotatable ring that has at least one position that prevents engagement member 48 from being positioned within at least one selection cavity 34. For example, if locking member 60 is in a particular position, it can prevent selection member 40 from being moved into a position that would allow fluid communication between first fluid pathway 36 and the second fluid pathway 38 connected to hot water, thus providing a safety feature. In the illustrated embodiment of FIG. 12, locking member 60 rotates 90 degrees to lock out the hot water, though any other range of motion could be used, for example. Alternatively, locking member 60 can engage seating member 42 or a separate blocking device within a second fluid pathway 38, for example. Also, locking member 60 can have multiple points of engagement to allow for blocking fluid communication to multiple second fluid pathways 36, either singly or in combinations, for example.

Locking member 60 or seating cavity 32 may include an adjustment member 62 for the off position, for example. The adjustment member 62 can provide feedback (e.g., tactile and/or visual) that the stem is in the off position and/or prevent the handle from drifting away from the off position, for example. Adjustment member 62 can be a tab, a detent, or a spring for example. In the exemplary embodiment as shown in FIGS. 11 and 12, adjustment member 62 is a tab on rotatable ring 60 that engages selection member 40. An adjustment stop 64 is positioned within a groove of a faucet housing, for example. Adjustment stop 64 is sized and shaped to engage either end wall of the groove, thereby preventing rotatable ring 60 from further rotational movement. As shown in FIG. 11, with rotatable ring 60 in an open position, adjustment member 62 engages selection member 40 but does not prevent selection member 40 from being positioned within any of selection cavities 34. As shown in FIG. 12, with rotatable ring 60 in a closed position, adjustment member 62 engages selection member 40 such that selection member 40 is prevented from being moved into at least one selection cavity 34, thereby preventing the flow of hot water for example.

Figure 13:
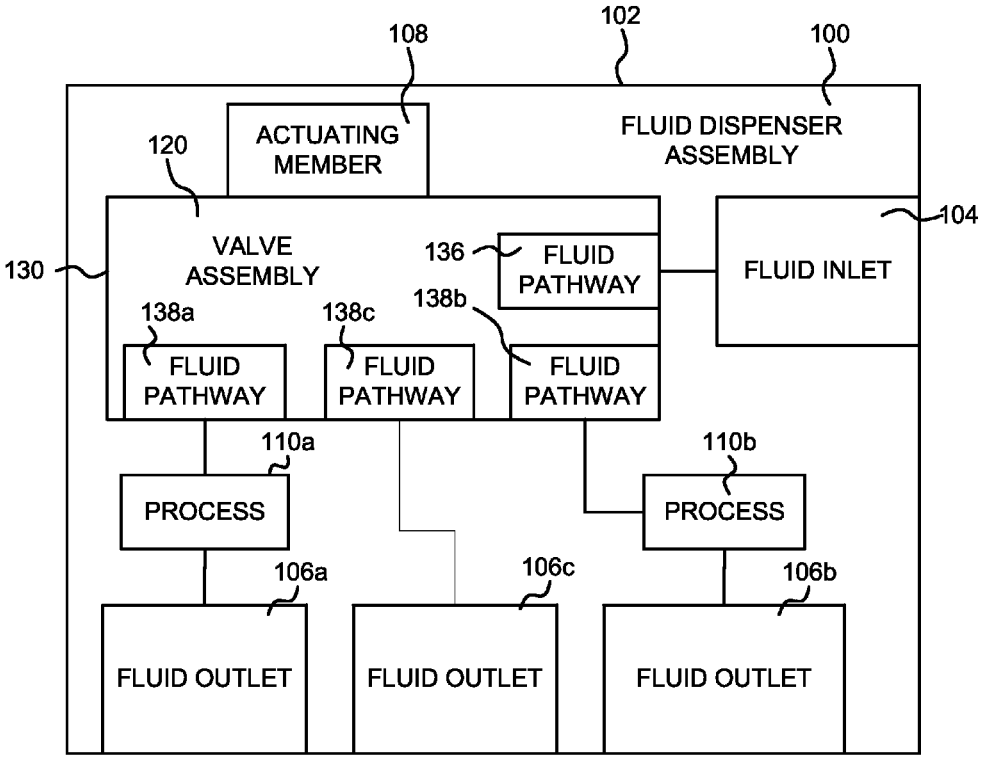
FIG. 13 is a schematic block diagram of a fluid dispenser assembly, according to an exemplary embodiment.

Referring to FIG. 13, a schematic block diagram of a fluid dispenser assembly 100 is shown, according to an exemplary embodiment. The fluid dispenser assembly includes a dispenser housing 102 having at least one fluid inlet 104 and at least one fluid outlet 106*a*, 106*b*, 106*c* an actuating member 108, and a valve assembly 120. The valve assembly 120 includes a housing 130 having a seating cavity, at least one selection cavity, and at least one first fluid pathway 136 and at least one second fluid pathway 138*a*, 138*b*, 138*c*, and a selection member having a seating portion and an engagement portion, wherein at least a portion of the seating portion is contained within a portion of the seating cavity. Each fluid pathway 138*a*, 138*b*, 138*c* can provide/direct the incoming fluid to a desired process 110 before it is eventually distributed, such as heating, chilling, or mixing with other fluids for example. In an exemplary embodiment, the fluid inlet 104 is room temperature water and the fluid outlets include one fluid outlet 106*a* connecting to a heater 110*a*, one fluid outlet 106*b* connecting to a chiller 110*b*, and one fluid outlet 106*c* allowing the room temperature water to pass through.

It will be understood that there are numerous modifications of the illustrated embodiments described above which will be readily apparent to one skilled in the art, such as variations and modifications of the valve assembly and/or its components, including combinations of features disclosed herein that are individually disclosed or claimed herein, explicitly including additional combinations of such features, or alternatively other types of valve assemblies. For example, valve assemblies can have more than one first fluid pathway or more than one selection member or housing. Also, there are many possible variations in the materials and configurations. These modifications and/or combinations fall within the art to which this disclosure relates and are intended to be within the scope of the claims, which follow.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the valve assembly as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

The invention claimed is:

1. A valve assembly comprising: a housing having a seating cavity, a first pattern of multiple selection cavities, and at least one first and second fluid pathway, wherein the first pattern is one of a Y pattern or a T pattern; a selection member having a seating portion and an engagement portion movable within the pattern of selection cavities; and a locking member configured to prevent fluid communication between a first of the at least one first fluid pathway and a first of the at least one second fluid pathway; wherein at least a portion of the seating portion is contained within a portion of the seating cavity, and wherein the engagement portion moves through a first position when the engagement portion is moved between the selection cavities.

2. The valve assembly of claim 1, wherein the first and second fluid pathways form a second pattern.

3. The valve assembly of claim 2, wherein the second pattern is one of a Y pattern, a T pattern or a linear pattern.

4. The valve assembly of claim 2, wherein the second pattern is one of a Y pattern or a T pattern.

5. The valve assembly of claim 1, wherein the locking member includes a rotatable ring having a first position that prevents the engagement member from being positioned within at least one of the selection cavities and having a second position that allows the engagement member to be positioned within the at least one of the selection cavities.

6. The valve assembly of claim 5, wherein:

the locking member includes an adjustment member coupled to the rotatable ring;

when the rotatable ring is in the first position, the adjustment member covers the at least one of the selection cavities; and when the rotatable ring is in the second position, the at least one of the selection cavities is not covered by the adjustment member.

7. The valve assembly of claim 1, wherein the selection member is operated as a joystick.

8. The valve assembly of claim 1, wherein fluid communication between the first and second fluid pathways is volume controlled by one of a gate in at least one of the first and second fluid pathways, a filter in at least one of the first and second fluid pathways, and the size and shape of the seating portion.

9. The valve assembly of claim 1, wherein the locking member further comprises an adjustment member that engages the selection member when the locking member is in a first position and is disengaged from selection member when the locking member is in a second position.

10. The valve assembly of claim 1, wherein the housing has only one fluid inlet and one of two fluid outlets and three fluid outlets.

11. The valve assembly of claim 1, wherein the housing has only one fluid outlet and one of two fluid inlets and three fluid inlets.

12. A fluid dispenser assembly comprising:

a dispenser housing having at least one fluid inlet and at least one fluid outlet;

a valve assembly located in the dispenser housing, the valve assembly comprising:

a housing having a seating cavity, at least one selection cavity, at least one fluid inlet fluidly coupled to the at least one fluid outlet of the dispenser housing and at least one fluid outlet fluidly coupled to the at least one fluid outlet of the dispenser housing; and a selection member having a seating portion and an engagement portion;

wherein at least a portion of the seating portion is contained within a portion of the seating cavity; and a locking member configured to prevent fluid communication between a first fluid pathway and a second fluid pathway.

13. The valve assembly of claim 12, wherein the locking member includes a rotatable ring having a first position that prevents the engagement member from being positioned within at least one of the selection cavities, and a second position that allows the engagement member to be positioned within the at least one of the selection cavities.

14. The valve assembly of claim 13, wherein:

the locking member includes an adjustment member coupled to the rotatable ring;

when the rotatable ring is in the first position, the adjustment member covers the at least one of the selection cavities; and when the rotatable ring is in the second position, the at least one of the selection cavities is not covered by the adjustment member.

15. The fluid dispenser of claim 12, wherein the locking member comprises:

a rotatable ring; and an adjustment stop configured to prevent further rotational movement of the locking member.

16. A fluid dispenser assembly comprising: a dispenser housing having at least one fluid inlet and at least two fluid outlets; a valve assembly, the valve assembly comprising: a housing defining a seating cavity therein, defining at least one selection cavity extending through the housing to the seating cavity, having at least one inlet fluid pathway fluidly coupled to the at least one fluid inlet, having a first outlet fluid pathway fluidly coupled to a first of the at least two fluid outlets, and having a second outlet fluid pathway fluidly coupled to a second of the at least two fluid outlets; and a selection member having a seating portion and an engagement portion; wherein: at least a portion of the seating portion is contained within a portion of the seating cavity; the at least one selection cavity comprises a first selection cavity and a second selection cavity; when the selection member is positioned in the first selection cavity, fluid is directed to the first outlet fluid pathway; and when the selection member is position in the second selection cavity, fluid is directed to the second outlet fluid pathway; at least one process located between one of the first and second outlet fluid pathways and the at least two fluid outlets, the at least one process comprising a heater located between the first outlet fluid pathway and the first of the at least two fluid outlets; and a locking member having a first position that prevents the engagement portion from entering the first selection cavity, thereby preventing fluid communication between the inlet fluid pathway and the first outlet fluid pathway connected to the heater.

17. The fluid dispenser of claim 16, wherein the at least one process comprises one of a heater and a chiller.

18. A valve assembly comprising: a housing including: a seating cavity therein; at least one first fluid pathway and at least one second fluid pathway, and an outer wall, wherein the outer wall defines a first pattern of multiple selection cavities, a selection member including: a seating portion, at least a portion of which is contained within a portion of the seating cavity; and an engagement portion movable within the first pattern of multiple selection cavities, wherein the engagement portion moves through a first position when the engagement portion is moved between the selection cavities; and a locking member configured to prevent fluid communication between a first of the at least one first fluid pathway and a first of the at least one second fluid pathway; wherein the locking member includes a rotatable ring having a first position that prevents the engagement portion from being positioned within at least one of the selection cavities and having a second position that allows the engagement portion to be positioned within the at least one of the selection cavities.

19. The valve assembly of claim 18, wherein the first and second fluid pathways form a second pattern.

20. The valve assembly of claim 19, wherein the second pattern is one of a Y pattern, a T pattern or a linear pattern.

21. The valve assembly of claim 18, wherein the first pattern is one of a Y pattern, a T pattern or a linear pattern.

22. The valve assembly of claim 18, wherein the locking member further comprises an adjustment member that engages the selection member when the locking member is in a first position and is disengaged from selection member when the locking member is in a second position.

23. The valve assembly of claim 18, wherein: the locking member includes an adjustment member coupled to the rotatable ring; when the rotatable ring is in the first position, the adjustment member covers the at least one of the selection cavities; and when the rotatable ring is in the second position, the at least one of the selection cavities is not covered by the adjustment member.

* * * * *